US008205887B2

(12) United States Patent
Wyland

(10) Patent No.: US 8,205,887 B2
(45) Date of Patent: Jun. 26, 2012

(54) GAME TABLE INCLUDING CUPS

(76) Inventor: Ryan Wyland, Williamsport, PA (US)

( * ) Notice: Subject to any disclaimer, the term of this patent is extended or adjusted under 35 U.S.C. 154(b) by 109 days.

(21) Appl. No.: 12/837,795

(22) Filed: Jul. 16, 2010

(65) Prior Publication Data

US 2012/0013073 A1 Jan. 19, 2012

(51) Int. Cl.
*A63B 67/00* (2006.01)
*A63B 63/00* (2006.01)
*A63F 7/00* (2006.01)

(52) U.S. Cl. ..... 273/342; 273/317; 273/400; 273/398

(58) Field of Classification Search ..... 273/309, 273/340–342, 400–402, 317, 348; 473/496; 108/20, 25, 26, 161; D21/338, 341
See application file for complete search history.

(56) References Cited

U.S. PATENT DOCUMENTS

| | | | | |
|---|---|---|---|---|
| 4,762,327 | A | 8/1988 | Gomez | |
| 7,325,807 | B1 * | 2/2008 | Eason | 273/342 |
| 7,370,776 | B2 | 5/2008 | Gomi | |
| 7,516,960 | B1 * | 4/2009 | Battiste | 273/342 |
| 7,805,959 | B2 * | 10/2010 | Webb et al. | 62/457.3 |
| 8,006,980 | B1 * | 8/2011 | Herro et al. | 273/342 |
| 8,028,995 | B2 * | 10/2011 | Hoffer | 273/342 |
| 2004/0188942 | A1 * | 9/2004 | Trokan | 273/342 |
| 2005/0029747 | A1 * | 2/2005 | Grayson | 273/342 |
| 2006/0027971 | A1 | 2/2006 | Radhakrishnan | |
| 2006/0157152 | A1 | 7/2006 | Wolski et al. | |
| 2006/0226606 | A1 * | 10/2006 | Finley et al. | 273/342 |
| 2007/0107460 | A1 * | 5/2007 | Webb et al. | 62/457.3 |
| 2009/0194941 | A1 * | 8/2009 | Boyd et al. | 273/340 |
| 2010/0148434 | A1 * | 6/2010 | Brustmeyer | 273/108 |
| 2011/0204570 | A1 | 8/2011 | Lombardi | |
| 2011/0270751 | A1 * | 11/2011 | Csinger et al. | 705/42 |

FOREIGN PATENT DOCUMENTS

WO WO 2011105983 * 9/2011

* cited by examiner

*Primary Examiner* — Raleigh W. Chiu
(74) *Attorney, Agent, or Firm* — Ice Miller LLP

(57) ABSTRACT

In certain embodiments, the present disclosure is directed to a game table that has a plurality of cups that may be automatically moved from a storage position to a playing position. In certain other embodiments, the present disclosure is directed to a game table that has a plurality of cups that may be manually moved from a storage position to a playing position. In certain other embodiments, the present disclosure is directed to devices and methods that allow a user to provide a payment mechanism, and upon the acceptance of the payment mechanism, a game table will move a plurality of cups from a storage position to a playing position. In some embodiments, provision is made for the dispensing of a liquid drink or other reward when predetermined actions occur during play of the game. Although the presently disclosed embodiments will work with any game requiring cups for play, the disclosure makes reference to the game of Beer Pong for convenience of description. No limitation of the disclosure is thereby intended or to be inferred.

29 Claims, 5 Drawing Sheets

GAME TABLE INCLUDING CUPS

TECHNICAL FIELD OF THE DISCLOSURE

The present disclosure generally relates to game tables and, more particularly, to a game table including cups.

BACKGROUND OF THE DISCLOSURE

The present disclosure will make use of the rules for a popular game called Beer Pong as an exemplary game that may be played with the disclosed devices and methods; however, those skilled in the art will recognize that the presently disclosed devices and methods will find utility in the play of a great many other games having rules of play that differ, either slightly or completely, from the rules of Beer Pong. To give just one non-limiting example, a popular game known as "Quarters" may also be played with the disclosed devices and methods. The devices and methods disclosed herein are therefore intended to also relate to such other games and rules of play, whether now known or hereafter developed.

Beer Pong (sometimes alternatively known as "Beirut") is a drinking game in which players throw a table tennis ball across a table with the intent of landing the ball in a cup of beer or other drink at the other end of the table. The game typically is played by a pair of two-to-four-player teams. As shown in FIG. 1, the gaming surface consists of multiple cups 10 arranged on each end of the table 12, with the cups 10 set up in triangle formation. There are no official rules, so rules may vary widely, though usually there are six or ten plastic cups 10 arranged in a triangle on each side of the table 12. All of the cups 10 are filled with an amount of beer (or other drink). Players from each team take turns attempting to throw or bounce a table tennis ball into the cups 10 arranged at their opponent's end of the table 12.

There are very few universal or "official" rules for the play of Beer Pong. Typically, players abide by a uniform set of "house rules", which are often consistent within one university or region of the country (e.g., "Ivy League rules" or "West Coast rules"), or may vary on a "house-by-house" basis. The number of cups 10 used on the game surface 12, requirements to bounce the ball when making a shot, the amount of alcohol in a cup 10, the distance shots must be taken from, etcetera, may all vary.

In some house rules, players must immediately drink the contents of any cup 10 on the players' side of the table 12 into which a ball has landed. Failure to do so incurs a penalty, such as drinking more beer or even losing the game. Some rule sets allow for "re-racking" (also known as "rearranging", "consolidation", and other names), which is a rearrangement of a team's remaining cups 10 after some have been removed. The initial formation of the cups 10, the number of cups 10, when to rearrange the cups 10 and so on depend on the particular rule set being used. For example, in some rule sets a team with three remaining cups 10 may ask the other team to "re-rack" their multiple targets into a single triangle formation. Formations for several different numbers of cups are illustrated in FIG. 2.

In some instances, the losing team (i.e. the team that has been forced to drink the contents of all of the cups 10 on that team's end of the table 12) must consume all of the beer remaining in the winning team's cups 10. The order of play varies—both players on one team may shoot followed by both players on the other team, or players on opposite teams may alternate back and forth.

The cups 10 are normally used throughout a session of play and therefore are likely used by multiple players to consume their contents. Such sharing of the cups 10 increases the risk of the transmission of communicable diseases. It has been previously recognized that there may be a transmission of germs into the drink when the ball lands in the cup 10. The ball has been handled by all of the players, and has also been in contact with the playing surface of the table 12 and usually the ground surface under the table 12, and is therefore far from sanitary. Many Beer Pong games make provision for a wash cup 14 so that the player may dunk the ball into water in order to wash off the ball prior to making a shot.

Even with such precautions, Beer Pong may have several health issues associated with it. Beer Pong, as with any activity involving alcohol, may cause players to become intoxicated or even drunk enough to get alcohol poisoning. Especially in commercial bar settings, it is difficult for bartenders and wait staff to monitor alcohol consumption because beer is brought to the table 12 communally. Also, the supposed cleaning effects of the water wash cup 14 may be offset by the uncleanliness of the wash cups 14 themselves, making the provision of wash cups 14 actually worse than having no wash cups 14 in some cases. Research has shown that the wash cups 14 themselves hold bacteria, such as *E. coli*. In early 2009, news sources cited a recent study by the U.S. Center of Disease Control (CDC) that stated that Beer Pong was contributing to the spread of herpes, mononucleosis, and other diseases through shared cups. Recently, there have been reports of the transmission of swine flu through the cups 10 used while playing Beer Pong. Additionally, the U.S. National Institute of Health (NIH) recommends avoiding the sharing of eating and drinking utensils to prevent the transmission of certain contagious viruses such as herpes.

Therefore, there is a need for improved devices and methods for the play of Beer Pong and other games that utilize cups and balls. The present disclosure is directed toward meeting this need.

SUMMARY OF THE DISCLOSURE

In certain embodiments, the present disclosure is directed to a game table that has a plurality of cups that may be automatically moved from a storage position to a playing position.

In one embodiment, a game table is disclosed, comprising a playing surface having a top surface and a bottom surface, a plurality of openings formed through the playing surface, a plurality of cups, wherein each of said plurality of cups is disposed adjacent a respective one of said plurality of openings, a plurality of linear translation devices, each of said linear translation devices having a first position and a second position, wherein each of said linear translation devices interacts with a respective one of said plurality of cups, wherein placing one of said plurality of linear translation devices into said first position positions a respective one of said plurality of cups into a storage position in which a majority of said cup is positioned below said playing surface, and wherein placing one of said plurality of linear translation devices into said second position positions a respective one of said plurality of cups into a playing position in which at least a portion of said cup is positioned above said playing surface.

In certain other embodiments, the present disclosure is directed to devices and methods that allow a user to provide a payment mechanism, and upon the acceptance of the payment mechanism, a game table will move a plurality of cups from a storage position to a playing position. In some embodiments, provision is made for the dispensing of a liquid drink or other reward when predetermined actions occur during play of the game. Although the presently disclosed embodiments will work with any game requiring cups for play, the disclosure makes reference to the game of Beer Pong for convenience of description. No limitation of the disclosure is thereby intended or to be inferred.

DETAILED DESCRIPTION OF THE DISCLOSED EMBODIMENTS

Figure 1:
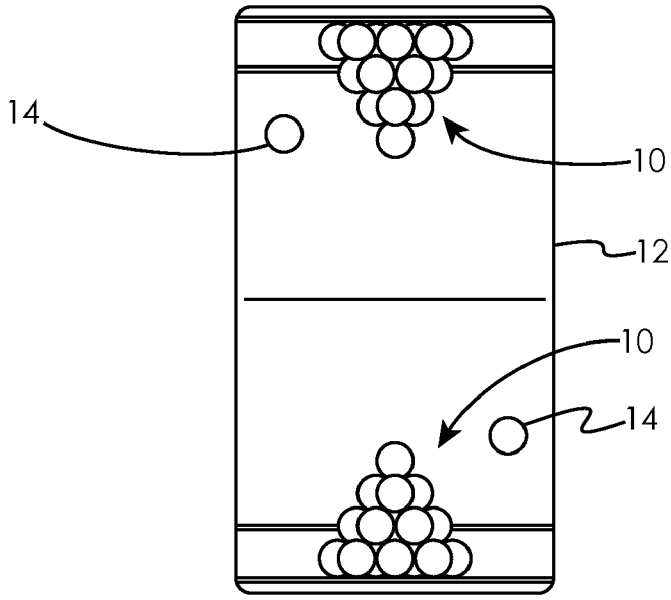
FIG. 1 is a plan view of a prior art Beer Pong table.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, and alterations and modifications in the illustrated systems, and further applications of the principles of the disclosure as illustrated therein are herein contemplated as would normally occur to one skilled in the art to which the disclosure relates.

In certain embodiments, the present disclosure is directed to a game table that has a plurality of cups that may be automatically moved from a storage position to a playing position. In certain other embodiments, the present disclosure is directed to a game table that has a plurality of cups that may be manually moved from a storage position to a playing position.

In certain other embodiments, the present disclosure is directed to devices and methods that allow a user to provide a payment mechanism, and upon the acceptance of the payment mechanism, a game table will move a plurality of cups from a storage position to a playing position. In some embodiments, provision is made for the dispensing of a liquid drink or other reward when predetermined actions occur during play of the game. Although the presently disclosed embodiments will work with any game requiring cups for play, the disclosure makes reference to the game of Beer Pong for convenience of description. No limitation of the disclosure is thereby intended or to be inferred.

Figure 3:
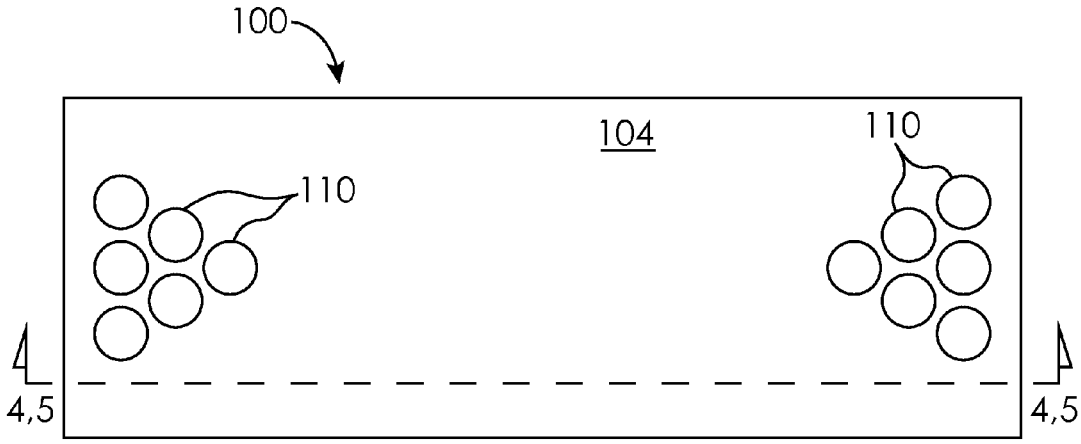
FIG. 3 is a plan view of a game table according to one embodiment of the present disclosure.

Referring to FIGS. 3-6, one embodiment of a game table is disclosed and indicated generally at 100. Game table 100 has a body portion 102 supporting a playing surface 104, both of which together define a game table interior 106. In certain embodiments, the game table 100 includes walls surrounding all of, or a portion of, playing surface 104. The game table 100 is supported by a plurality of legs 108. A plurality of openings 110 are formed through the playing surface 104. A total of twelve openings 110, arranged as triangular grids of 6 openings at each end of the playing surface 104, are illustrated in FIG. 3; however, the playing surface 104 may have greater or fewer openings, and differing arrangements of openings, as the rules of play dictate for the game being played on game table 100. The illustrated arrangement is common for the game of Beer Pong. The playing surface 104 may include a sponsor's trademark or other indicia.

Associated with each opening 110 is a cup 112. Cups 112 are illustrated in a storage position in FIG. 4 and in a playing position in FIG. 5. When in the storage position, the upper rims of cups 112 are positioned at or below the playing surface 104. When in the playing position, the upper rims of cups 112 are positioned above the playing surface 104. The cups 112 may be moved from the storage position to the playing position, and vice versa, by any convenient means of linear translation, such as by a stepper motor linear actuator or a lead screw assembly, to name just two non-limiting examples. As used herein, "means of linear translation" and "linear translation device" are intended to encompass manual operation, where the motive force used to move the cups 112 is supplied by the user, such as by a manually operated device. One such means is illustrated by way of non-limiting illustration in FIGS. 4-5 and comprises a cam 114 that may be rotated by means of a source of rotary motion (not shown), such as a stepper motor. In the storage position, the bottom surface of the cup 112 is not in contact with the cam 114 lobe. As the cam 114 is rotated in a clockwise direction, the cam 114 lobe comes into contact with the bottom surface of the cup 112 and pushes the cup 112 upward through the opening 110. Rotation of the cam 114 counterclockwise will move the cam 114 lobe off of the bottom surface of the cup 112 and return the cup 112 to the storage position. Providing for independent control of the rotation of the cams 114 (as discussed hereinbelow) allows selected cups 112 to be raised and lowered independently, which is a requirement in certain games to be played with the game table 100.

Figure 6:
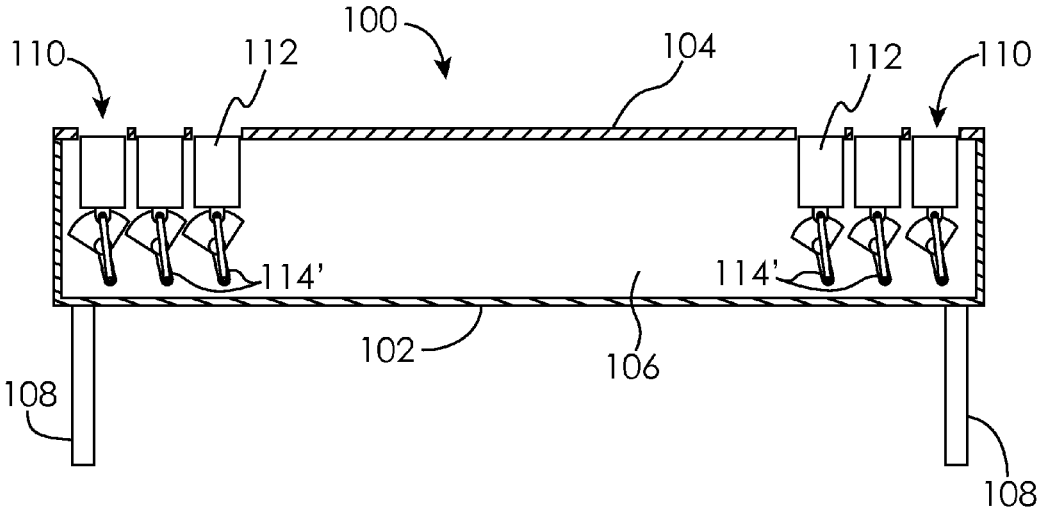
FIG. 6 is a cross-sectional view of the game table of FIG. 3 utilizing a second cup lifting mechanism, showing the cups in a storage position.
Figure 7:
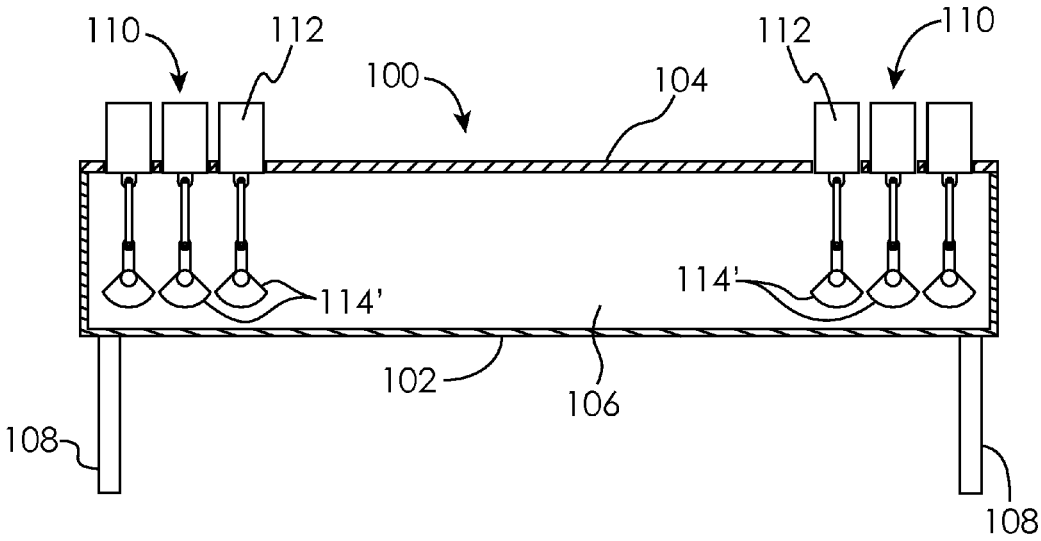
FIG. 7 is a cross-sectional view of the game table of FIG. 3 utilizing the second cup lifting mechanism, showing the cups in a playing position.

Another means of linear translation of the cups 112 is illustrated in FIGS. 6-7 and comprises a crankshaft and connecting rod assembly 114' that may be rotated by means of a source of rotary motion (not shown), such as a stepper motor. In the storage position, the crankshaft is rotated such that the connecting rod is at or near bottom dead center. As the crankshaft 114' is rotated, the connecting rod is moved to top dead center and thereby pushes the cup 112 upward through the opening 110. Further rotation of the crankshaft 114' (either clockwise or counterclockwise) will lower the connecting rod back toward bottom dead center and thereby return the cup 112 to the storage position. Providing for independent control of the rotation of the crankshaft 114' (as discussed hereinbelow) allows selected cups 112 to be raised and lowered independently, which is a requirement in certain games to be played with the game table 100.

In certain embodiments, the cups 112 are raised and lowered manually. For example, the crankshaft and connecting rod arrangement illustrated in FIGS. 6-7 may be implemented without an electromechanical source of rotary motion to drive it. Instead, the cups may be raised by the player manually grasping the cup 112 and pulling upward to the playing position. In certain embodiments, a detent or the like is provided to hold the cup 112 in the playing position. Similarly, when the player pushes downward on a cup 112 (with a force great enough to overcome the detent if one is provided), the crankshaft and connecting rod will be rotated until the cup 112 is in the storage position. In certain embodiments, a detent or the like is provided to hold the cup 112 in the storage position. In embodiments that include a payment acceptor (discussed hereinbelow), the mechanism holding the cups 112 in the storage position may be unlocked when proper payment is supplied to the payment acceptor, allowing the cups 112 to be manually raised. Thereafter, pushing a cup 112 down to the storage position may engage a lock on the mechanism, preventing the cup 112 from be raised again until proper payment is once again supplied to the payment acceptor to initiate another game. Those skilled in the art will recognize that any number of mechanisms may be employed to implement this functionality.

In certain embodiments, the cups 112 are partially filled with a sanitary solution (the composition of which is not critical to the present disclosure). The provision of the sanitary solution in the cups 112 allows the interaction of the game ball with the cups 112 to more accurately resemble the game of Beer Pong (e.g. the sanitary solution reduces the likelihood of the ball bouncing out of the cup 112 when the ball enters the cup 112). In other embodiments, the cups 112 are left empty. Appropriate plumbing may be provided to fill and/or drain the sanitary solution from the cups 112. In certain other embodiments, the cups 112 may be filled with any other material. By way of non-limiting example, the cups 112 may be filled with saw dust, confetti or ground nut shells.

In certain other embodiments, the cups 112 may be designed to be easily removable from the game table 100 so that they may be easily cleaned and/or replaced if damaged. In some embodiments, the cups 112 are disposable and may be replaced as often as every game. The cups 112 may be constructed from any desired material including, but not limited to, metal, plastic or glass.

Figure 8:
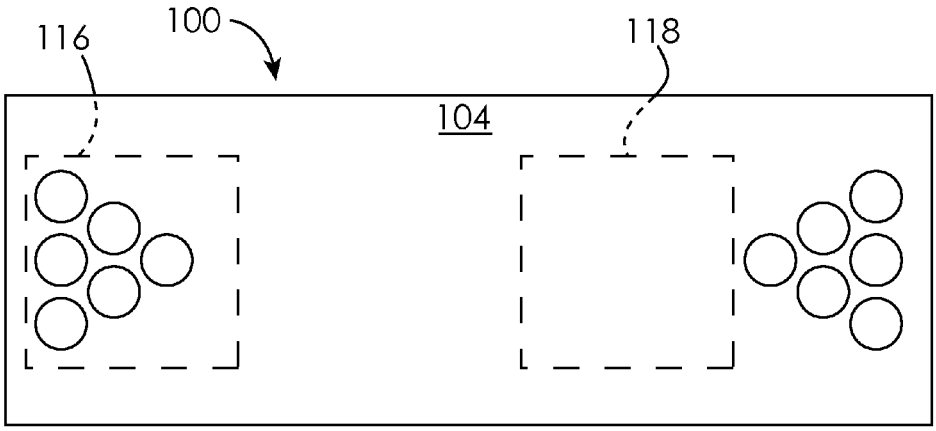
FIG. 8 is a plan view of the game table of FIG. 3, showing sliding covers according to one embodiment of the present disclosure.

In certain embodiments, the openings 110 may be closed when the game table 100 is not in use. As shown in FIG. 8, covers 116 and 118 may be provided on the underside of the playing surface 104. In certain embodiments, the covers 116, 118 slide in grooves (not shown) provided for the purpose. The covers 116, 118 may be opened and closed by means of any convenient mechanism, such as a scissor mechanism (to name just one non-limiting example). In certain other embodiments, the covers 116, 118 may be manually opened and closed. Provision of the covers 116, 118 prevent the cups 112 of the game table 100 from being used when in the storage position, as discussed in greater detail hereinbelow. In other embodiments, the openings 110 are not covered when the game table 100 is not in use, and in some embodiments the game table 100 may be used for game play when the cups 112 are in the storage position. In certain other embodiments, the covers may be opened to expose less than all of the cups 112. For example, the cups 112 may be arranged in a triangular formation of ten cups, but the cover may be moved to expose only six of the cups for a game. In some embodiments, a larger payment is required to gain access to ten cups per side than to gain access to six cups per side. In other embodiments, there is a separate cover for each cup 112 that may be individually opened and closed. By way of non-limiting example, each opening 110 may have a cover hinged to the game table playing surface 104. The cover may swing downward to open the opening 110, and the cup 112 may be raised and lowered through the opening. When the cup 112 is lowered, the cover may be swung upward to close the individual opening. Those skilled in the art will recognize that a variety of mechanisms can be envisioned which will accomplish this motion for each cover, such as a linear actuator mounted to the underside of the game table playing surface 104 that engages the bottom side of the cover in a sliding engagement.

Figure 9:
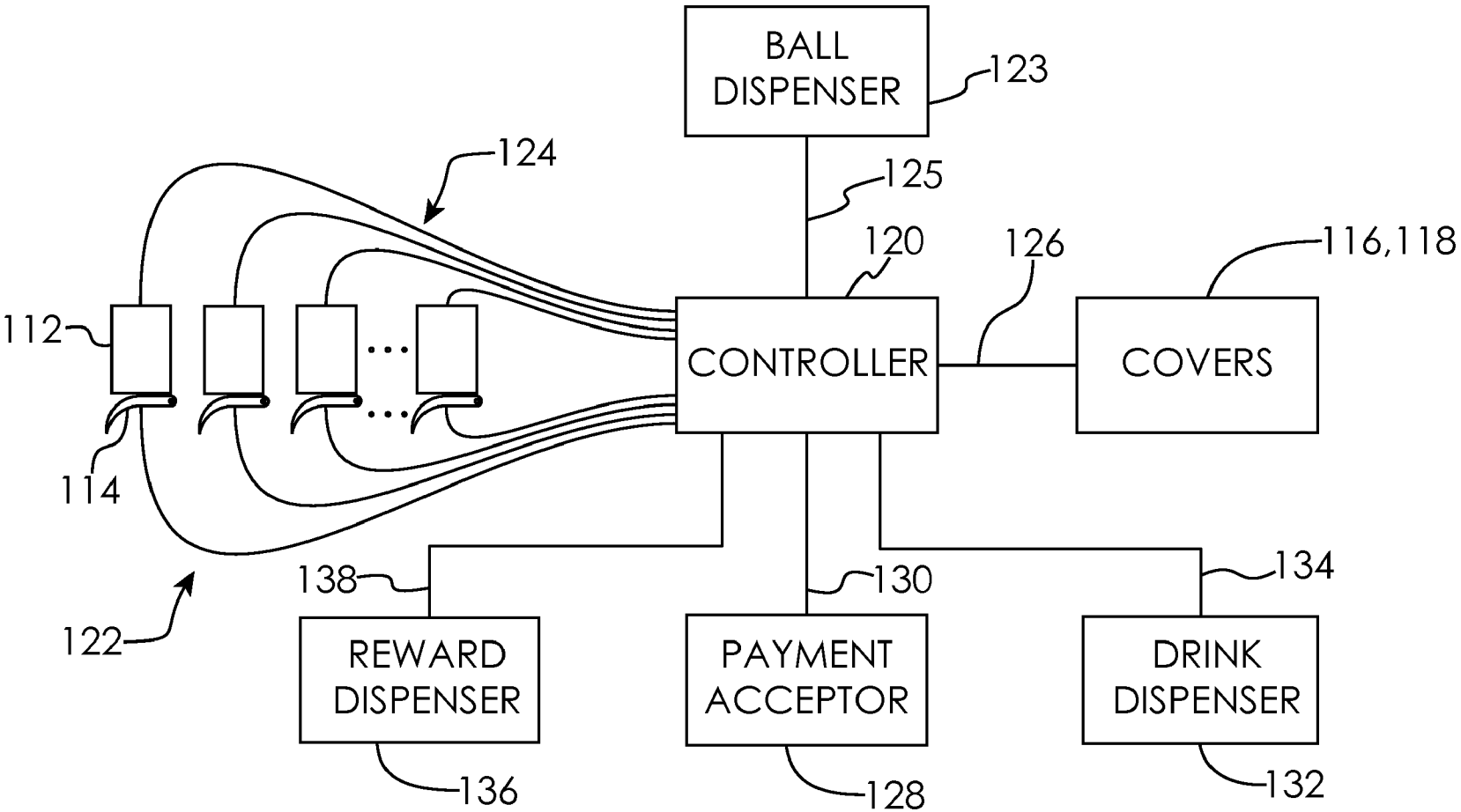
FIG. 9 is a schematic block diagram showing a game table control system according to one embodiment of the present disclosure.

Referring now to FIG. 9, there is illustrated a schematic block diagram of one embodiment control system for controlling the operation of the game table 100. A controller 120 is provided, and may comprise any desired computing device, such as a microprocessor and associated memory for the storage of the software instructions to be executed by the microprocessor. Controller 120 also includes appropriate input/output circuits to send and receive signals to the various components to which it is connected, as discussed hereinbelow.

Each of the linear translation devices, such as cams 114 and their associated rotary motors, are coupled to the controller 120 by means of lines 122. By placing an appropriate signal on the line 122 associated with the cam 114 that is desired to be moved, the controller 120 is able to independently control each of the cams 114 (and hence independently control each of the cups 112) in order to move the cups 112 from the storage position to the playing position (and vice versa). In certain embodiments, the same control line is coupled to each of the cams 114, with each of the cams 114 having an appropriate addressable receiver such that the cam 114 responds only to a command on the control line that is addressed to that particular cam 114, as is known in the art.

Controller 120 is also coupled to each of the cups 112 in certain embodiments by means of lines 124. In certain embodiments, each of the cups 112 may be provided with an appropriate sensor that can communicate with the controller 120 in order to inform the controller 120 that a ball has been successfully placed into a cup 112 by one of the players. The sensor can be any desired sensor. By way of non-limiting example, the sensor may comprise a light source and light detector placed in the interior of the cup 112, such that when a ball is positioned inside the cup 112 it prevents the light beam from reaching the light detector, causing a signal to be sent to the controller via one of the lines 124. As another non-limiting example, the sensor may be a proximity switch coupled to a metal cup 112, such that a player tapping the cup 112 with his hand or finger will cause a signal to be sent to the controller via one of the lines 124. In certain embodiments, the controller determines that a ball has been placed into a cup 112 when the cup is tapped twice in succession (within a predetermined time period) by one of the players. In other embodiments, the controller 120 is notified by any other convenient means, such as by the players pressing a button or entering appropriate data into a keypad or keyboard associated with the controller 120.

In certain embodiments, a ball dispenser 123 is provided and coupled to the controller 120 by means of a line 125. At the start of game play, controller 120 may instruct the ball dispenser 123 (via line 125) to dispense a ball, such as a table tennis ball, to the users of the game table 100. In other embodiments, the users of game table 100 supply their own ball. In still other embodiments, a ball cleaning system may be provided to wash game balls. Such ball cleaning system may be incorporated into the ball dispenser 123 or provided separately.

In certain embodiments, a ball within a cup 112 is manually retrieved by one of the players. In other embodiments, the cup 112 may have an automatic ejection mechanism for removing the ball. By way of non-limiting example, a mechanism (such as a solenoid) may be placed in the bottom of the cup 112 that forcefully moves the ball upwards such that it pops out of the cup 112. This mechanism may be under the control of the controller 120. In certain embodiments, the ejection mechanism is activated by the controller 120 when the ball sensor is activated.

Controller 120 may also be coupled to the covers 116, 118 for control thereof by means of line 126. For example, if the covers are movable by means of a scissor mechanism, the controller 120 may be coupled to the motor that causes motion of the scissor mechanism so that the controller 120 has control over the opening and closing of the covers 116, 118. In certain embodiments, the covers 116, 118 can be opened and closed independently. In other embodiments, the covers 116, 118 are coupled to the same movement means and open and close together.

In certain embodiments, the game table 100 includes a payment acceptor 128. Payment acceptor 128 is coupled to the controller 120 by means of the line 130. Particularly when used in places of public amusement, payment acceptor 126 may be desired in order to allow the game table 100 to be used for game play. Payment acceptor 128 may be any device that allows a user to transfer something of value to the game table 100 in order to initiate play. By way of non-limiting example, the payment acceptor may be a currency coin acceptor, a currency bill acceptor, a card reader for reading card information such as credit, debit or other cards, a radiofrequency identification (RFID) sensor, a keypad for entering information, a token acceptor, or any other form of payment acceptance.

Figure 4:
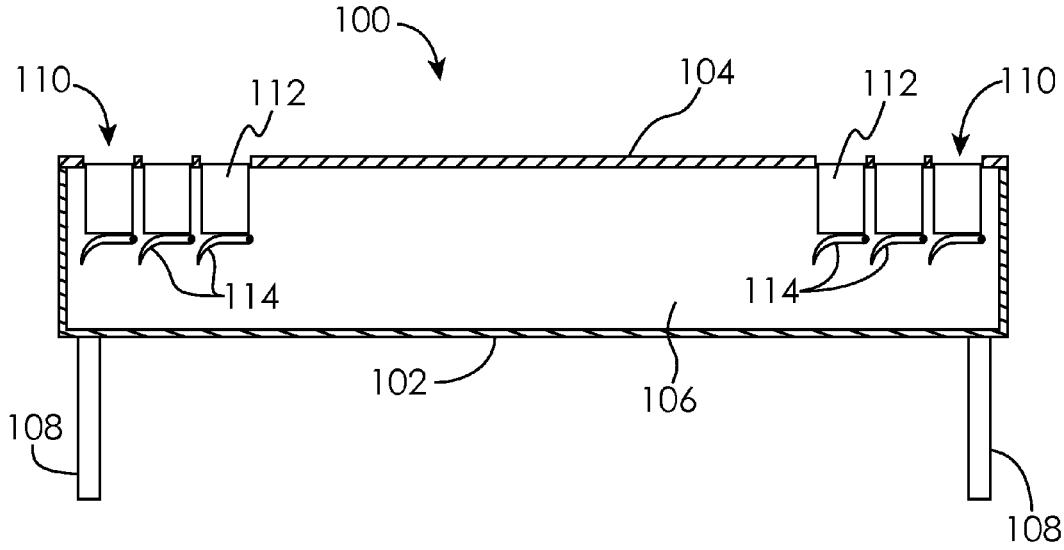
FIG. 4 is a cross-sectional view of the game table of FIG. 3 utilizing a first cup lifting mechanism, showing the cups in a storage position.
Figure 5:
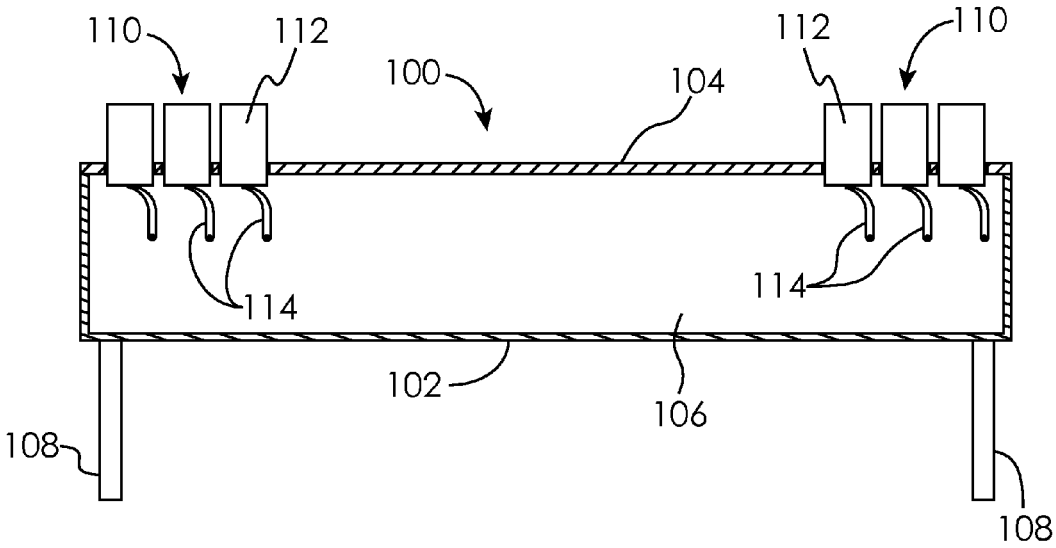
FIG. 5 is a cross-sectional view of the game table of FIG. 3 utilizing the first cup lifting mechanism, showing the cups in a playing position.

In certain embodiments, the cups 110 are maintained in the storage position of FIG. 4 and the covers 116, 118 are in place over the cups 110 such that the game table 100 may not be used for game play unless the appropriate payment mechanism is inserted into payment acceptor 128. Payment acceptor 128 communicates with controller 120 via line 130 to inform controller 120 what amount of payment has been entered into payment acceptor 128. Once the amount of payment entered equals or exceeds the required amount predetermined for game play, the controller opens the covers 116, 118 and commands the cams 114 to raise the cups 110 from the storage position to the playing position illustrated in FIG. 5.

In certain other embodiments, the game table 100 may be associated with a drink dispenser 132 for dispensing drinks. Drink dispenser 132 may be coupled to controller 120 by means of line 134. For example, if the game table is to be used for the play of Beer Pong, the drink dispenser 132 may be operative to dispense servings of beer. In other embodiments, the drink dispenser 132 is operative to dispense soft drinks, other alcoholic drinks, juices and/or water. In some embodiments, a drink dispenser 132 is provided at each end of the game table 100. In certain embodiments, the drink dispenser 132 is supplied with drink from a container associated with the game table 100. In certain other embodiments, drink from a central supply is plumbed to the drink dispenser 132.

In one embodiment, rather than playing Beer Pong with the game cups filled with beer that is to be drunk when a ball is successfully placed in the cup, the game table 100 allows game play with cups 110 that are empty. When the ball is successfully placed in a cup 110, the controller 120 is notified of this fact by means of a signal sent by the sensor in the cup 110 over lines 124. Upon such notification, controller 120 instructs drink dispenser 132 (by means of line 134) to allow one serving of beer to be dispensed. Such serving may be dispensed without the requirement of additional payment, or the serving may simply be made available for purchase, such as by providing additional payment to the payment acceptor 128. In this way, the players may each maintain their own drinking cups that are not shared by other players and which do not come into contact with the ball, thereby substantially reducing the risk of spreading communicable diseases.

Figure 2:
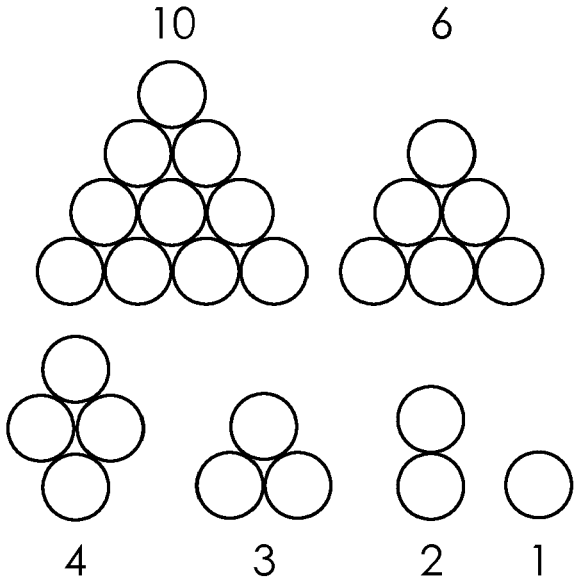
FIG. 2 is a plan view of several arrangements of cups in the play of Beer Pong.

In certain embodiments, when the controller 120 is notified that the ball has been successfully placed in a cup 110, the controller 120 operates the associated cam 114 (or other cup 110 lowering mechanism) to lower the cup 110 from the playing position to the storage position. At appropriate points in the game (either automatically or when instructed to do so by the players), the controller 120 may "re-rack" the remaining cups 110 that are in the playing position into any preferred configuration (as discussed above with respect to FIG. 2) by operating the appropriate cams 114 to raise or lower the appropriate cups 110. Once all of the cups 110 on one end of the game table 100 have been moved to the storage position, the game may be declared "over" and the remaining cups 110 in the playing position will be moved to the storage position. In embodiments with covers 116, 118, the covers 116, 118 may be moved to the closed position and the game table 100 is therefore ready to accept payment for another game.

In some jurisdictions, the automatic dispensing of alcohol may not be allowed under local laws. Therefore, certain embodiments of the game table 100 will not provide a drink dispenser 132. In some embodiments, the game table 100 may be used simply for the entertainment of the game play, without the award of drinks as part of the game play. In certain other embodiments, the controller 120 is able to award a drink by means of reward dispenser 136 coupled to controller 120 by means of line 138. Whenever the controller 120 determines that a drink should be awarded, the reward dispenser 136 may be activated by placing an appropriate signal on line 138. In certain embodiments, reward dispenser 136 dispenses a reward that may be redeemed for a drink by giving the reward to a member of the wait staff. The present disclosure is not limited to dispensing a reward from reward dispenser 136. In certain embodiments, reward dispenser 136 is operative to dispense tokens, to store information on a card inserted by a user, and/or notify a member of the wait staff that a drink should be brought to the game table 100. When using reward dispenser 136, therefore, the wait staff is able to monitor the intake of alcohol by the game players in order to prevent any player from drinking to excess. In all of the reward options disclosed herein, the reward may be something other than a drink.

Because the controller 120 has information relating to the progress of any game being played on game table 100, in some embodiments controllers 120 from separate game tables 100 may be coupled together (or may all be coupled to a central computing device) for the transmission and receipt of data, for example to allow for scorekeeping during tournament play. In certain embodiments, scores and/or bracket information for the tournament may be displayed on a display (not shown) associated with game table 100. In such embodiments, it is not necessary for all of the interconnected game tables 100 to be located at the same physical location.

It will be appreciated that the game table 100 disclosed herein is operative to allow for the play of games utilizing cups (including but not limited to Beer Pong) and to allow a place of public amusement to collect payment for the use of the game table 100. By providing cups 112 for game play that do not contain drinking beverages, the game table 100 provides a much more sanitary environment for the play of games utilizing cups and significantly reduces the chances of spreading communicable diseases. Furthermore, certain embodiments allow for drinks to be dispensed to the game players in such a way that the wait staff may monitor their intake of alcoholic beverages.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected. For example, the presently disclosed embodiments have been illustrated using the game of Beer Pong; however, it will be appreciated by those skilled in the art that any game that utilizes cups as part of the game apparatus is equally applicable to the disclosed devices and methods, and the present disclosure is intended to cover those alternatives.

What is claimed is:

1. A game table, comprising:

a playing surface having a top surface and a bottom surface;

a plurality of openings formed through the playing surface;

a plurality of cups, wherein each of said plurality of cups is disposed adjacent a respective one of said plurality of openings;

a plurality of linear translation devices, each of said linear translation devices having a first position and a second position, wherein each of said linear translation devices interacts with a respective one of said plurality of cups;

wherein placing one of said plurality of linear translation devices into said first position positions a respective one of said plurality of cups into a storage position in which a majority of said cup is positioned below said playing surface; and wherein placing one of said plurality of linear translation devices into said second position positions a respective one of said plurality of cups into a playing position in which at least a portion of said cup is positioned above said playing surface.

2. The game table of claim 1, wherein each of said plurality of linear translation devices comprises a cam.

3. The game table of claim 1, wherein each of said plurality of linear translation devices is selected from the group consisting of: manually operated device, crankshaft and connecting rod assembly, stepper motor linear actuator and lead screw assembly.

4. The game table of claim 1, further comprising a liquid solution disposed in each of said plurality of cups.

5. The game table of claim 4, wherein said liquid solution comprises a sanitary solution.

6. The game table of claim 1, further comprising:

at least one cover disposed adjacent said bottom surface, said at least one cover having a closed position and an open position;

wherein said at least one cover blocks at least a portion of said plurality of openings when said at least one cover is in said closed position; and wherein said at least one cover does not block at least a portion of said plurality of openings when said at least one cover is in said open position.

7. The game table of claim 6, further comprising:

a scissor mechanism operatively coupled to said at least one cover, said scissor mechanism having a first scissor mechanism position and a second scissor mechanism position;

wherein said at least one cover is in said closed position when said scissor mechanism is in said first scissor mechanism position; and wherein said at least one cover is in said open position when said scissor mechanism is in said second scissor mechanism position.

8. The game table of claim 1, further comprising:

a controller operatively coupled to each of said plurality of linear translation devices, wherein said controller is operative to place each of said linear translation devices into said first position or said second position.

9. The game table of claim 8, further comprising:

a plurality of object sensors, each of said plurality of object sensors having an object sensor output operatively coupled to said controller;

wherein each of said plurality of object sensors is operative to generate an object signal at said object sensor output indicative that an object has been placed into a respective one of said plurality of cups.

10. The game table of claim 9, wherein each of said plurality of object sensors comprises a light source and light detector pair.

11. The game table of claim 9, further comprising:

a plurality of object ejectors, each of said plurality of object ejectors being associated with a respective one of said plurality of cups and being operatively coupled to said controller;

wherein said controller is operative to cause each of said plurality of object ejectors to eject an object from a respective one of said plurality of cups when said object sensor associated with said respective one of said plurality of cups generates said object signal.

12. The game table of claim 8, further comprising:

a plurality of object ejectors, each of said plurality of object ejectors being associated with a respective one of said plurality of cups and being operatively coupled to said controller.

13. The game table of claim 8, further comprising:

a plurality of touch sensors, each of said plurality of touch sensors having a touch sensor output operatively coupled to said controller;

wherein each of said plurality of touch sensors is operative to generate a touch signal at said touch sensor output indicative that a respective one of said plurality of cups has been touched.

14. The game table of claim 13, wherein each of said plurality of touch sensors comprises a proximity switch.

15. The game table of claim 13, wherein said controller is operative to cause each of said plurality of linear translation devices to place a respective one of said plurality of cups into said storage position when said touch sensor associated with said respective one of said plurality of cups generates said touch signal.

16. The game table of claim 9, wherein said controller is operative to cause each of said plurality of linear translation devices to place a respective one of said plurality of cups into said storage position when said object sensor associated with said respective one of said plurality of cups generates said object signal.

17. The game table of claim 8, wherein said controller is operative to re-rack said plurality of cups by controlling said plurality of linear translation devices.

18. The game table of claim 8, further comprising:

a payment acceptor operatively coupled to said controller, said payment acceptor having a payment acceptor output operatively coupled to said controller;

wherein said payment acceptor is operative to generate a payment signal at said payment acceptor output indicative that payment of at least a predetermined amount has been received by said payment acceptor.

19. The game table of claim 18, wherein said payment acceptor is selected from the group consisting of a currency coin acceptor, a currency bill acceptor, a card reader, a radiofrequency identification (RFID) sensor, a keypad for entering information, and a token acceptor.

20. The game table of claim 8, further comprising:

a reward dispenser operatively coupled to said controller, said reward dispenser having a reward dispenser input operatively coupled to said controller;

wherein said reward dispenser is operative to dispense a reward after receiving an input from said controller at said reward dispenser input.

21. The game table of claim 20, wherein said reward comprises a drink.

22. The game table of claim 21, wherein said drink is selected from the group consisting of beer, soft drinks, non-beer alcoholic drinks, juices and water.

23. The game table of claim 8, further comprising:

a ticket dispenser operatively coupled to said controller, said ticket dispenser having a ticket dispenser input operatively coupled to said controller;

wherein said ticket dispenser is operative to dispense a ticket after receiving an input from said controller at said ticket dispenser input.

24. The game table of claim 23, wherein said ticket is selected from the group consisting of paper tickets, tokens, information stored on a card supplied by a user, and notification to a wait staff member.

25. The game table of claim 1, wherein said game comprises Beer Pong.

26. The game table of claim 1, further comprising trademark indicia on said playing surface.

27. The game table of claim 8, wherein said controller is coupled to a remote computing device for the transmission and receipt of data.

28. The game table of claim 1, wherein:

each of said plurality of linear translation devices is adapted to be placed manually into said first position when a player applies a downward force on said respective one of said plurality of cups; and each of said plurality of linear translation devices is adapted to be placed manually into said second position when a player applies an upward force on said respective one of said plurality of cups.

29. The game table of claim 8, further comprising:

a ball dispenser having a ball dispenser input operatively coupled to said controller;

wherein each of said ball dispenser is operative to dispense a ball when a predetermined control signal is received from the controller.

* * * * *